US011060282B2

(12) United States Patent
Spear

(10) Patent No.: US 11,060,282 B2
(45) Date of Patent: Jul. 13, 2021

(54) MODULAR WALL SYSTEM

(71) Applicant: Doug Spear, Clarkston, MI (US)

(72) Inventor: Doug Spear, Clarkston, MI (US)

(73) Assignee: Doug Spear, Clarkston, MI (US)

( * ) Notice: Subject to any disclaimer, the term of this patent is extended or adjusted under 35 U.S.C. 154(b) by 0 days.

(21) Appl. No.: 16/548,161

(22) Filed: Aug. 22, 2019

(65) Prior Publication Data

US 2020/0063434 A1 Feb. 27, 2020

Related U.S. Application Data

(60) Provisional application No. 62/721,952, filed on Aug. 23, 2018.

(51) Int. Cl.

| | |
|---|---|
| ***E04F 15/02*** | (2006.01) |
| ***E04B 1/61*** | (2006.01) |
| ***E04B 7/20*** | (2006.01) |
| ***E04C 1/42*** | (2006.01) |
| ***E04B 2/74*** | (2006.01) |
| *E04B 1/14* | (2006.01) |
| *E04C 1/39* | (2006.01) |

(52) U.S. Cl.

CPC ..... *E04B 2/7401* (2013.01); *E04B 1/61* (2013.01); *E04B 1/14* (2013.01); *E04B 7/20* (2013.01); *E04C 1/395* (2013.01); *E04C 1/42* (2013.01); *E04F 15/02* (2013.01); *E04F 2201/0115* (2013.01)

(58) Field of Classification Search

CPC ..... E04B 1/80; E04B 1/14; E04B 7/20; E04B 2/18; E04B 2/7401; E04B 1/61; E04B 2/7405; E04B 1/6133; E04B 1/12; E04B 5/02; E04C 1/395; E04C 1/42; E04F 15/02038; E04F 2201/0115; E04F 15/02

See application file for complete search history.

(56) References Cited

U.S. PATENT DOCUMENTS 3,760,548 A * 9/1973 Sauer ..... E04B 1/6812 52/592.1
3,877,671 A * 4/1975 Underwood ..... B61D 45/002 248/346.03
4,769,963 A * 9/1988 Meyerson ..... E04B 1/80 52/309.9
5,181,362 A * 1/1993 Benitez ..... E04B 2/18 52/578
5,247,773 A * 9/1993 Weir ..... E01F 8/0011 52/592.3

(Continued)

*Primary Examiner* — Phi D A
(74) *Attorney, Agent, or Firm* — Dinsmore & Shohl LLP

(57) ABSTRACT

A modular wall system includes a plurality of extruded wall panels each having opposing first and second surfaces and opposing first and second joiner side edges. Each joiner side edge has an edge surface adjacent the first surface, another edge surface adjacent the second surface and a tongue or groove disposed therebetween. The edge surfaces have an angle less than 90 degrees with respect to the first or second surface, respectively. The first joiner side edge is insertable into the second joiner side edge of another wall panel, with a flush fit, for interconnecting the wall panels. Each panel also has opposing top and bottom edges and a plurality of ribs connecting and perpendicular to the first surface and the second surface.

12 Claims, 5 Drawing Sheets

(56) References Cited

U.S. PATENT DOCUMENTS

| | | | | |
|---|---|---|---|---|
| 5,293,728 | A * | 3/1994 | Christopher | F16B 5/0016 52/309.9 |
| 5,647,181 | A * | 7/1997 | Hunts | A63H 33/10 312/111 |
| 5,783,286 | A | 7/1998 | DiNicola | |
| 6,739,106 | B2 * | 5/2004 | Curatolo | E04F 15/10 52/105 |
| 7,526,903 | B2 * | 5/2009 | Kandasamy | F24F 3/0442 52/588.1 |
| 7,546,716 | B1 * | 6/2009 | Asadurian | E04C 1/395 52/223.7 |
| 8,769,904 | B1 * | 7/2014 | Brandt | E04F 15/02038 52/588.1 |
| 9,366,018 | B1 * | 6/2016 | Merrick | E04H 3/10 |
| 2002/0069600 | A1 * | 6/2002 | Bryant | E04B 7/20 52/309.9 |
| 2003/0033769 | A1 * | 2/2003 | Record | E04B 1/14 52/270 |
| 2004/0103601 | A1 * | 6/2004 | Bergqvist | E04D 3/363 52/284 |
| 2006/0010810 | A1 * | 1/2006 | Muszynski | E04C 1/42 52/503 |

* cited by examiner

MODULAR WALL SYSTEM

CROSS REFERENCE TO RELATED APPLICATIONS

This application claims priority to U.S. Provisional Patent Application Ser. No. 62/721,952, filed Aug. 23, 2018, the entire content of which is incorporated herein by reference.

FIELD OF THE INVENTION

The present invention generally relates to the field of modular wall systems for temporary installations.

BACKGROUND OF THE INVENTION

Temporary walls or partitions are often used at construction sites, such as renovation or remodeling projects in malls, hotels, office buildings, hospitals and other public or private venues. These walls provide a safety and security barrier while the renovation or remodeling project is in progress. They may also block noise and other contaminants from entering public spaces on the other side of the wall. Typically, temporary walls or partitions are constructed on site using traditional building materials, such as lumber, drywall or plywood. This is costly, time consuming, needs skilled assembly and creates debris. Additionally, such temporary walls are difficult to reuse when they are no longer being needed at a particular location. They may be cosmetically imperfect after use, making them unsuitable for other locations.

SUMMARY OF THE INVENTION

Embodiments of the present invention provide a modular wall system including a plurality of extruded wall panels, each wall panel having a first surface and an opposing second surface, and a first joiner side edge and an opposing second joiner side edge. The first joiner side edge has a first edge surface adjacent the first surface, a second edge surface adjacent the second surface and a tongue disposed between the first edge surface and the second edge surface. The first edge surface and the second edge surface have an angle less than 90 degrees with respect to the first surface and the second surface, respectively. The opposing second joiner side edge has a third edge surface adjacent the first surface, a fourth edge surface adjacent the second surface and a groove disposed between the third edge surface and the fourth edge surface. The third edge surface and the fourth edge surface have an angle less than 90 degrees with respect to the first surface and the second surface. The first joiner side edge of each wall panel is insertable into the second joiner side edge of another wall panel for interconnecting the wall panels. The second joiner side edge accommodates the first joiner side edge to assure a flush fit between the wall panel and the another wall panel. The panel also has a top edge and an opposing bottom edge, and a plurality of ribs connecting and perpendicular to the first surface and the second surface.

In some versions, the system has a top track that is received onto the top edges of the plurality of extruded wall panels. The top track may have a generally "U" shaped cross sectional profile with a base and interconnecting and parallel spaced apart outer walls.

In some versions, the system has a floor supported track for seating the bottom edges of the plurality of extruded wall panels.

In certain embodiments, the first surface, the second surface, the first joiner side edge, the second joiner side edge and/or the plurality of ribs of each panel comprise a rigid PVC material. The wall panels may be made entirely of recyclable material.

In some versions, the top edge and bottom edge of each wall panel are open.

Some versions further include an angular member for engaging the first joiner side edge and the second joiner side edge of the adjacent ones of the wall panels in order to arrange the adjacent wall panels at an angle with respect to each other.

Some versions further include a first end member and a second end member for engaging the first joiner side edge and the second joiner side edge, respectively, of a first and a last of the wall panels of the modular wall system.

In some versions, the wall panel has a U-shaped tongue and/or groove.

DETAILED DESCRIPTION OF THE INVENTION

The present invention provides embodiments of a modular wall system having a plurality of wall panels that interlock edge to edge so as to form a generally continuous wall with seams between the adjacent wall panel being minimized with a flush fit. An exemplary modular wall system may include the plurality of the wall panels only or may also include a top and/or bottom track which receives the respective edge of each wall panel. This system may also include one or more braces or other elements to assist in the structural integrity of the system. Such a modular wall system may be used as a temporary wall system around construction or remodeling sites, or as wall panels to form a temporary enclosure, such as for a trade show. Other uses are also possible.

Figure 1:
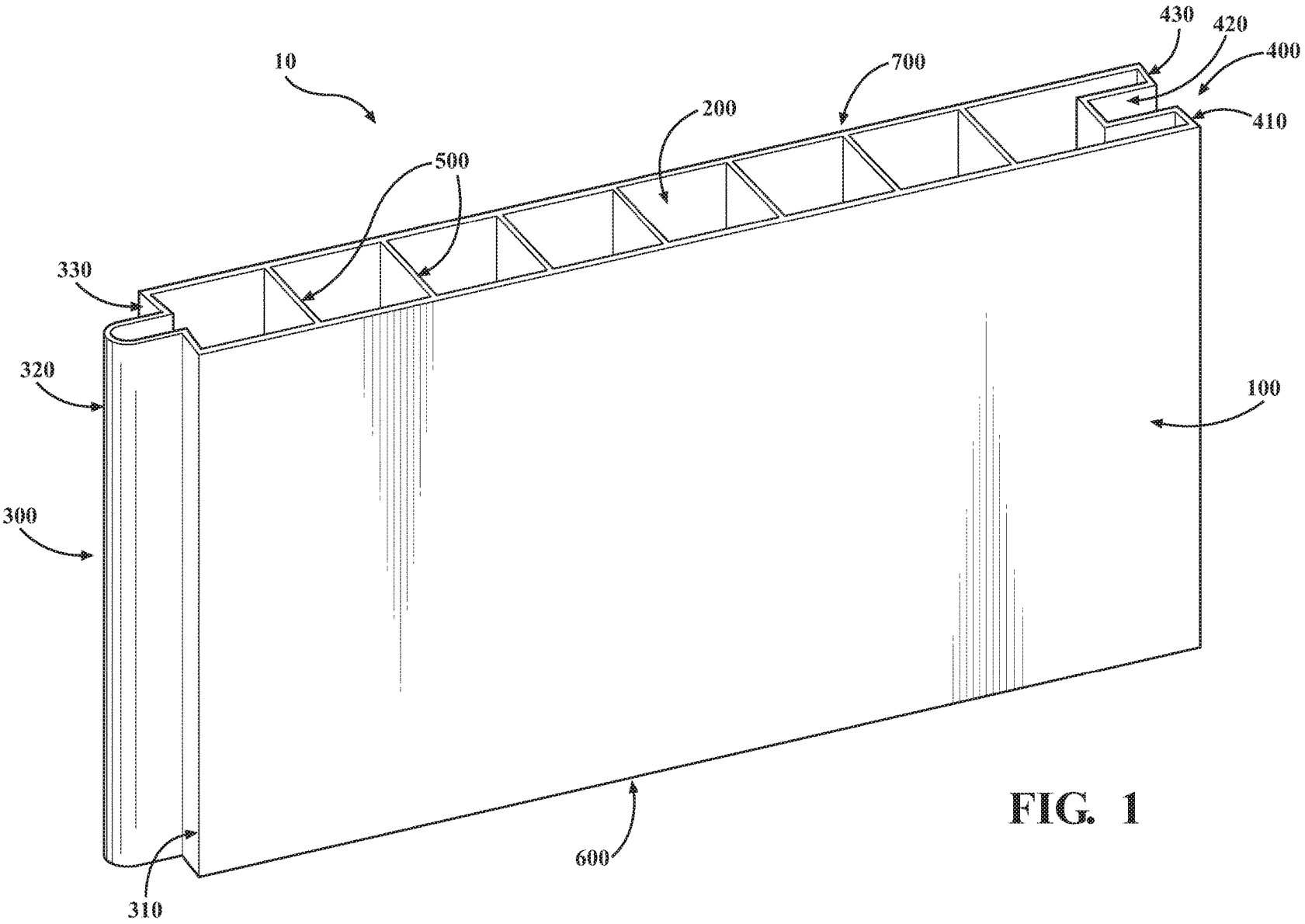
FIG. 1 is a perspective view of a wall panel in accordance with an embodiment of the present invention.

Referring to FIG. 1, an exemplary wall panel is shown at 10. The wall panel has a height and width that are arbitrarily chosen for purposes of the illustration. Those of skill in the art will understand that panels of any practical height or width may be produced with the structural design as illustrated. The wall panel 10 has a first surface 100 defining a face of the panel and an opposed second surface 200 defining an opposed face of the panel. A first joiner side edge 300 and an opposing second joiner side edge 400 each extend between and interconnect the first surface 100 and the second surface 200. The width on the panel 10 is defined as the distance between the first joiner side edge 300 and the second joiner side edge 400 and may be equal to the width of the first and second surfaces 100 and 200. A height of the panel 10 is defined between a bottom edge 600 and a top edge 700. The panel 10 is preferably extruded in the height direction and therefore has a cross sectional shape that is continuous and constant along the height. In FIG. 1, the exposed top edge represents the extrusion shape. A plurality of spaced apart ribs 500 extend between and interconnect the first surface 100 and the second surface 200. As shown, the ribs 500 may be spaced apart by equal distances and be perpendicular to both the first surface 100 and the second surface 200.

Figure 2:
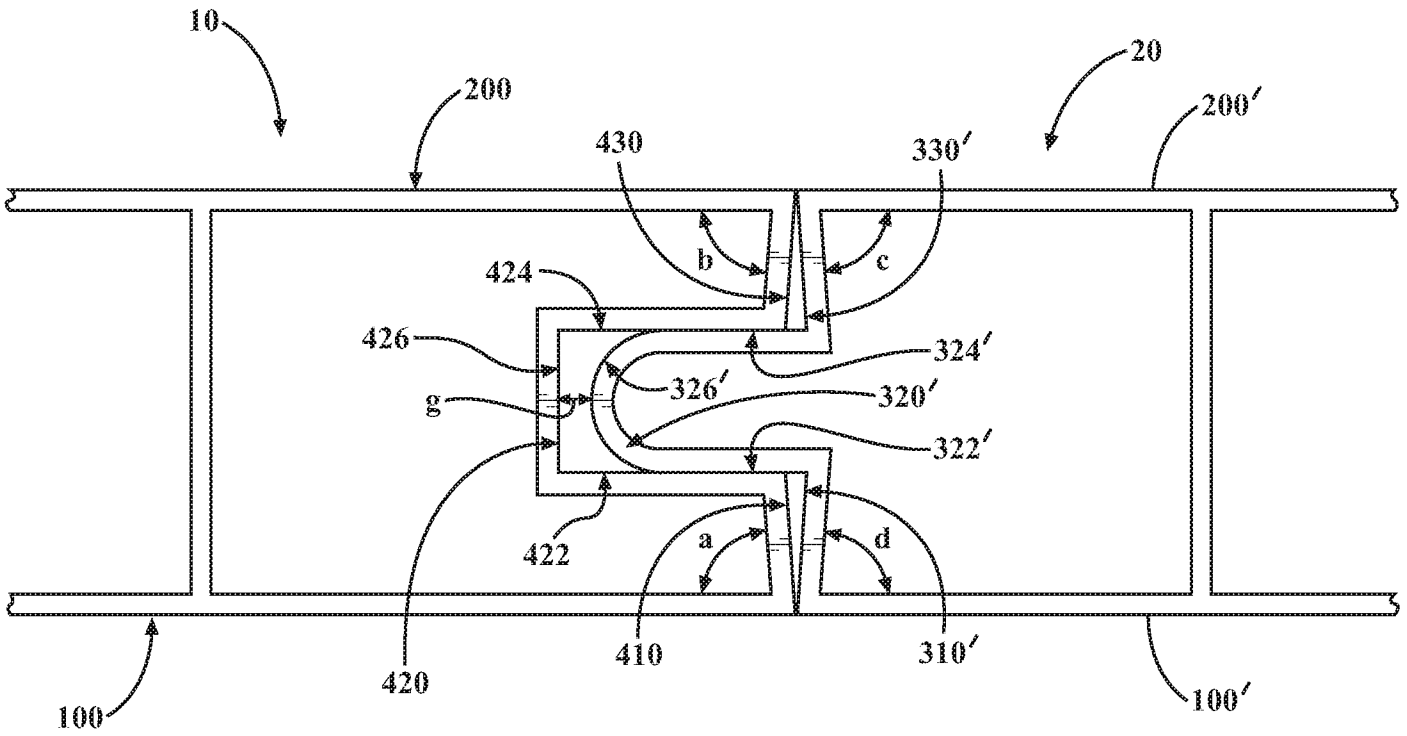
FIG. 2 is a detailed view of the joiner edges of adjacent interlocking wall panels with a tongue engaging a groove.

As shown, the first joiner side edge 300 includes a tongue 320 and the second joiner side edge 400 includes a groove 420. FIG. 2 shows a portion of a first panel 10 and a second panel 20 with the tongue 320' of the second panel 20 engaging the groove 420 of the first panel 10. As best shown in FIG. 2, the first joiner side edge has a first edge surface 310' adjacent to the first surface 100', a second edge surface 330' adjacent to the second surface 200', and the tongue 320' disposed between the first edge surface 310' and the second edge surface 330'. Specifically, the tongue 320' has a pair of generally parallel side walls 322' and 324' extending from the inward end of the edge surfaces 310' and 330', respectively. An end portion 326' joins the side walls 322' and 324'. In the illustrated embodiment, the tongue 320' is equidistant from the first and second surfaces, 100' and 200'.

The second joiner side edge 400 has a first edge surface 410 adjacent the first surface 100 and a second edge surface 430 adjacent the second surface 200, with the groove 420 joined to the inner ends of the edge surfaces. Specifically, the groove 420 has a pair of generally parallel side walls 422 and 424 that extend inwardly (into the inside of the panel 10) from the inner ends of the edge surfaces 410 and 430. An end portion 426 joins the first and second side walls 422 and 424. In this example, the end portion 426 is straight and perpendicular to the side surfaces 422 and 424. Preferably, the groove 420 is deeper than the length of the tongue 320' such that a gap g remains when the panel 20 engages the panel 10.

As shown, the edge surfaces are each joined to the respective panel surfaces (100 and 200) at an angle a, b, c, d, that are each less than 90 degrees. Put another way, each of the edge surfaces angles inwardly towards the interior of the panel as compared to if the edge surfaces were perpendicular to the panel surfaces 100 and 200. The angles a-d may be referred to as interior angles. As best shown in FIG. 2, this enhances a flush fit between the panels 10 and 20 since the edge surfaces are at minimal contact. Put another way, the panel 20 engages panel 10 until the outer faces of the surfaces 100' and 200' abut the surfaces 100 and 200, respectively.

Referring again to FIG. 1, the top edge 700 is shown as being open, with the plurality of ribs 500 being visible. The term "open," as used herein, means that the top edge 700 has the shape as defined by the extrusion process, and no closing panel is added nor modification is made so as to close off this open edge. The bottom edge 600 is likewise open, having a shape that is identical to the top edge 700, as will be clear to those of skill in the art. Preferably, the panel 10 is a plastic extrusion with the entirety of the panel 10 formed of the same material. By avoiding closure elements at the top and bottom edges, 700 and 600, or any other added components, the recyclability of the panel 10 is enhanced. Because the entirety of the panel is made from the same material, the entire panel may be recycled with an appropriate process for the plastic forming the panel. Foreign materials are avoided.

In one example, the panel 10 has a thickness, defined as the distance between the outer face of the first surface 100 and the outer face of the second surface 200, of 1.125 inches. The panel 10 may have a width, defined as the width of the first surface 100 and second surface 200, of 36 inches. The height or length of the panel 10 is determined by when the exterior part is cut, thereby allowing panels of any practical height. As examples, the height may be 6 or 8 feet. In one example, the ribs 500 are at an on-center distance of 1 inch from each other and each have a thickness of 0.040 inches (1.0 millimeter). In the same example, the first surface 100 and second surface 200 each have a thickness of 0.059 inches (1.5 millimeters). In some examples, the angles a-d are approximately 88 degrees. This means that the outer faces of the edge surfaces form an angle of 2 degrees versus a line perpendicular to the panel faces 100 and 200. In further examples, the angles a-d may be increased closer to or farther from 90 degrees, as long as the flush fit feature is maintained. In some examples, the angles a-d are in the range of 85 to 89 degrees. In further examples, the angles may not all be the same. For example, the angles a and b may be 86 degrees while the angles c and d are 87 or 88 degrees. In a further example, the inward slope of the edge surfaces may be provided only on one or the other ends. For example, angles a and b may be 86 degrees while angles c and d are 90. However, it is preferred that all of the angles a-d are less than 90 degrees.

Figure 3:
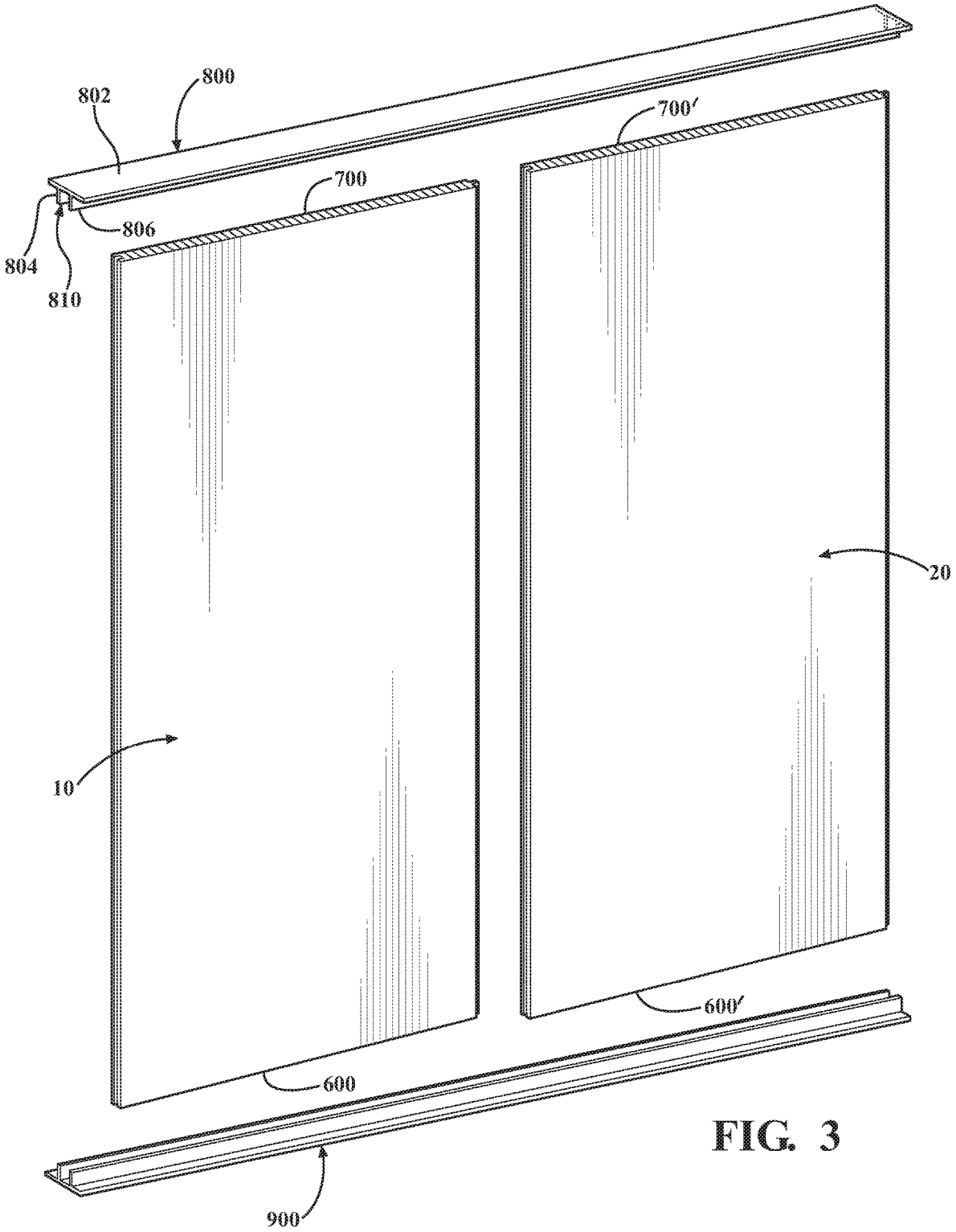
FIG. 3 is a perspective view of a pair of interlocking wall panels and a base track and a top track to show the manner in which they may be assembled.

Referring now to FIG. 3, the modular wall system may further include a top track 800 for receiving the top edges 700 and 700' of adjacent wall panels 10 and 20. The top track 800 may have a flat upper element 802 and two downwardly extending flanges 804 and 806 that are spaced apart so as to define a receiving slot 810. The top track 800 cosmetically finishes off the panels, thereby hiding the open edges, and also further stabilizes and joins the panels. While only two panels are shown, many more panels may be used and the top track 800 may be much longer. The corresponding bottom track 900 may also be provided for receiving the bottom edges 600 and 600' of the panels 10 and 20. The bottom track 900 may take a form similar to the top track 800, or may be identical thereto.

Figure 4:
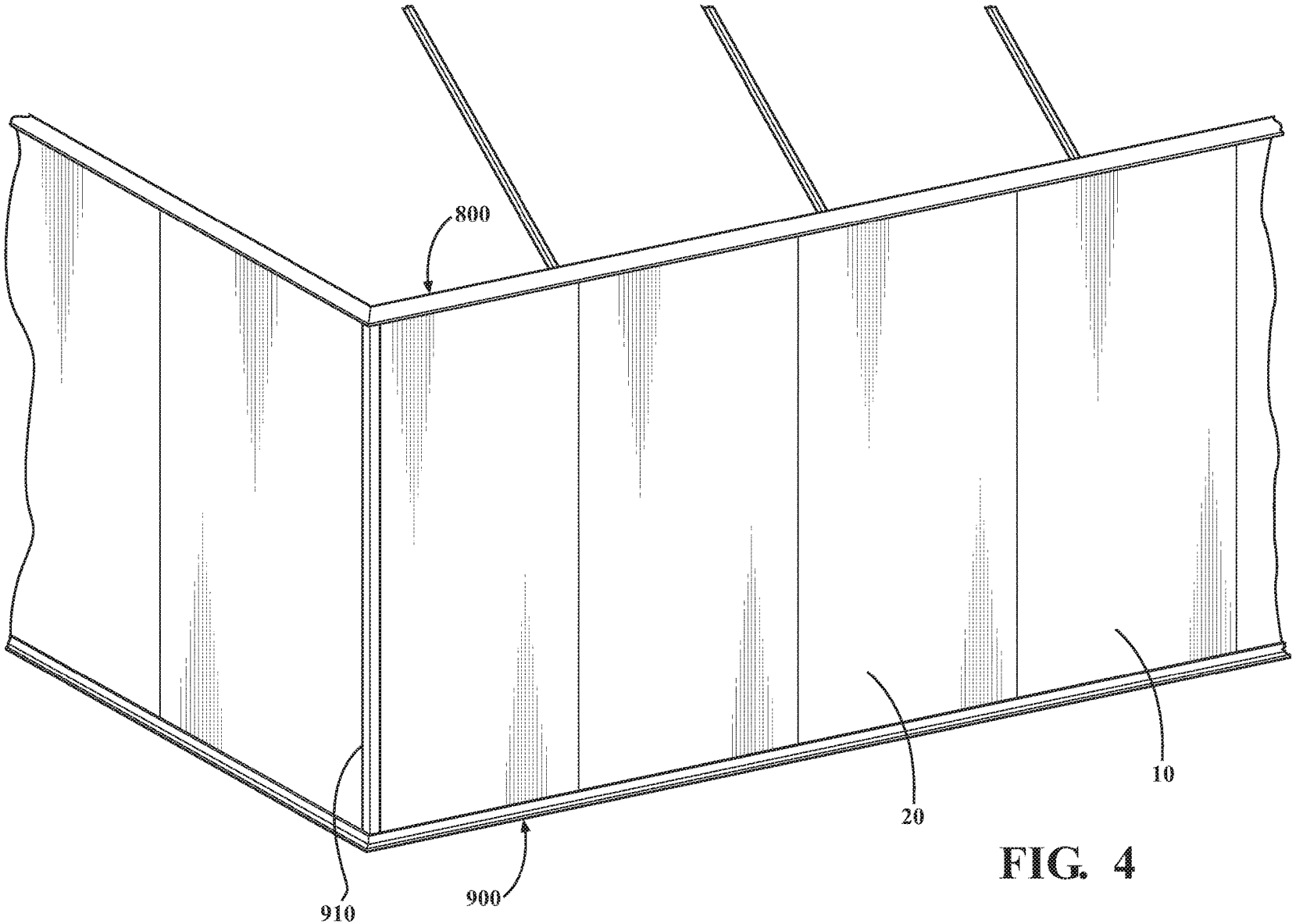
FIG. 4 is a perspective view of an assembled wall system in accordance with an embodiment of the present invention.

Referring now to FIG. 4, a modular wall system is illustrated including a plurality of panels joined to one another and joined to top track 800 and bottom track 900. In this example, multiple panels are joined edge-to-edge to form a first plane and additional panels are joined side-to-side to form a second plane, with the two planes meeting at a corner 900. As will be clear those of skill in the art, a corner element 910 may be provided for interconnecting the edges of panels that meet at an angle. A plurality of angled top braces is also shown.

Figure 5:
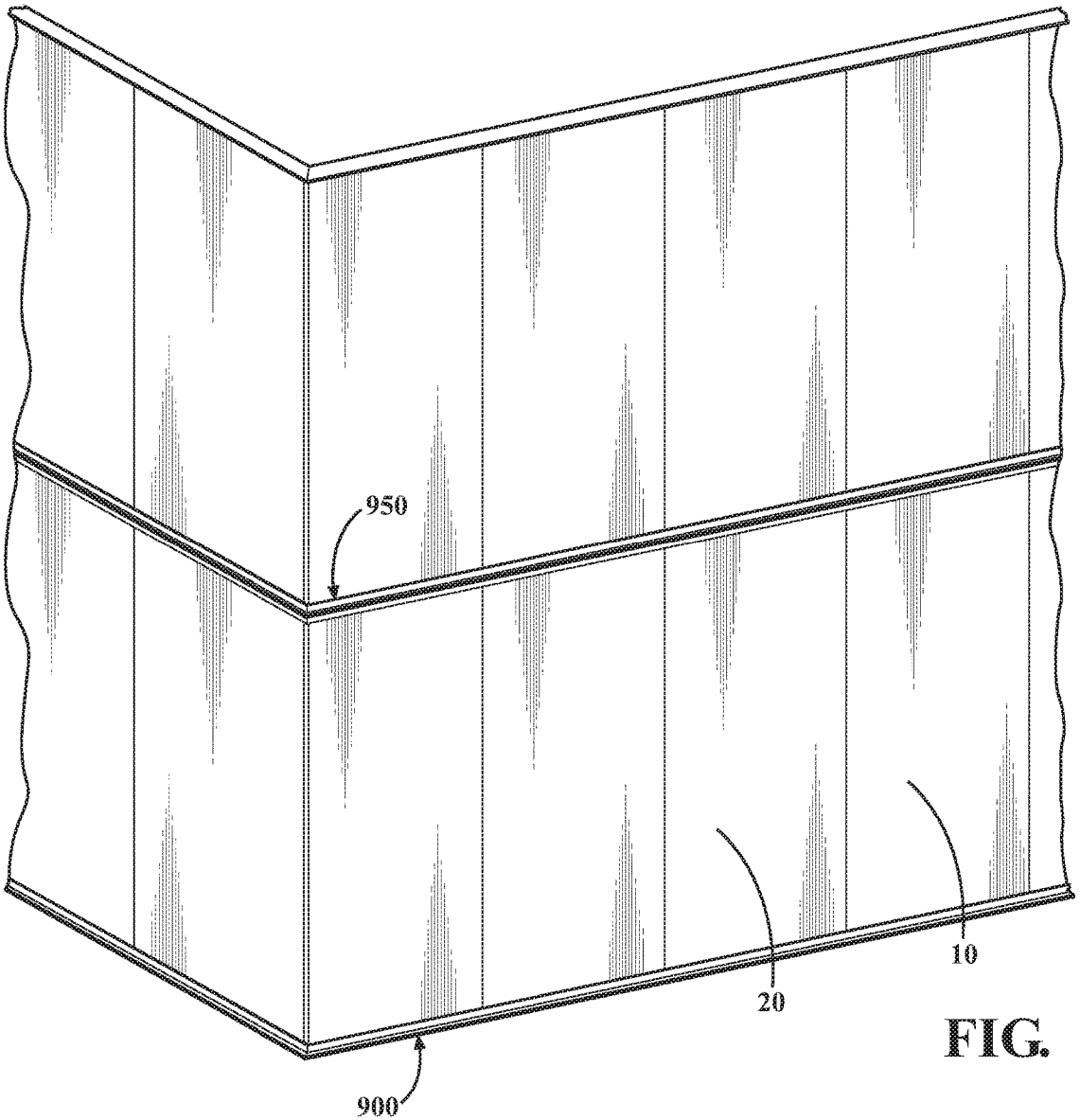
FIG. 5 is a perspective view of an assembled wall system in accordance with a further embodiment of the present invention.

Referring now to FIG. 5, a further embodiment of a modular wall system is illustrated. In this example, a first set of panels rests on a floor and a second set rests on top of the first set, with a joining element 950 interconnecting the sets. The joining element may have upwardly facing and downwardly facing slot for receiving the bottom edge and top edge, respectively, of stacked panels. This allows for increased height.

As will be clear to those of skill in the art, the herein described embodiments of the present invention may be altered in various ways without departing from the scope or teaching of the present invention. It is the following claims, including all equivalents, which define the scope of the present invention.

The invention claimed is:

1. A modular wall system, comprising:

a plurality of extruded wall panels, each wall panel consisting essentially of:

a first surface and an opposing second surface, and a first joiner side edge and an opposing second joiner side edge;

the first joiner side edge having a first edge surface immediately adjacent to and extending from the first surface, a second edge surface immediately adjacent to and extending from the second surface and a tongue disposed between the first edge surface and the second edge surface, the tongue consisting essentially of a pair of generally flat and parallel side walls each extending directly from one of the edge surfaces continuously to a distal end and an end portion interconnecting the distal ends by extending inwardly from each distal end towards the other distal end, the generally flat and parallel side walls defining a maximum width of the tongue;

the first edge surface and the second edge surface having an inside angle less than 90 degrees with respect to the first surface and the second surface, respectively;

the opposing second joiner side edge having a third edge surface immediately adjacent to and extending from the first surface, a fourth edge surface immediately adjacent to and extending from the second surface and a groove disposed between the third edge surface and the fourth edge surface and extending into the wall panel, the groove consisting essentially of a pair of generally flat and parallel side walls each extending directly from one of the edge surfaces continuously to a distal end and an end portion interconnecting the distal ends by extending inwardly from each distal end towards the other distal end, the end portion of the groove being recessed with respect to the third and fourth edge surfaces, the generally flat and parallel side walls defining a maximum width of the groove;

the third edge surface and the fourth edge surface having an inside angle less than 90 degrees with respect to the first surface and the second surface, respectively;

the tongue of the first joiner side edge of each wall panel being insertable into the groove of the second joiner side edge of another wall panel for interconnecting the wall panels, wherein the generally flat side walls of the tongue being coextensive with the generally flat side walls of the groove, the second joiner side edge accommodating the first joiner side edge to assure a flush fit between the wall panel and the another wall panel;

a top edge and an opposing bottom edge; and a plurality of ribs connecting and perpendicular to the first surface and the second surface;

wherein each panel is a single plastic extrusion and the entirety of each panel is formed of the same material.

2. The modular wall system of claim 1, further comprising a top track that is received onto the top edges of the plurality of extruded wall panels.

3. The modular wall system of claim 2, wherein the top track comprises a generally "U" shaped cross sectional profile with a base and interconnecting and parallel spaced apart outer walls.

4. The modular wall system of claim 1, further comprising a floor supported track for seating the bottom edges of the plurality of extruded wall panels.

5. The modular wall system of claim 1, wherein the first surface, the second surface, the first joiner side edge, the second joiner side edge and/or the plurality of ribs comprise a rigid PVC material.

6. The modular wall system of claim 1, wherein each of the wall panels is formed entirely of recyclable material.

7. The modular wall system of claim 1, wherein the top and bottom edges of each of the panels are open.

8. The modular wall system of claim 1, further comprising an angular corner element operable to engage the first joiner side edge and the second joiner side edge of the adjacent ones of the wall panels in order to arrange the adjacent wall panels at an angle with respect to each other.

9. The modular wall system of claim 1, further comprising a first end member and a second end member for engaging the first joiner side edge and the second joiner side edge, respectively, of a first and a last of the wall panels of the modular wall system.

10. The modular wall system of claim 1, wherein each wall panel has a U-shaped tongue and/or groove.

11. The modular wall system of claim 1, wherein the angles less than 90 degrees are in the range of 85 to 89 degrees.

12. The modular wall system of claim 1, wherein the end portion of the groove is substantially flat and extends generally straight between the distal ends.

* * * * *